US010981766B2

(12) United States Patent
Scott

(10) Patent No.: US 10,981,766 B2
(45) Date of Patent: Apr. 20, 2021

(54) CAPPING CHUCK ASSEMBLY

(71) Applicant: Michael P. Scott, Midland, MI (US)

(72) Inventor: Michael P. Scott, Midland, MI (US)

( * ) Notice: Subject to any disclaimer, the term of this patent is extended or adjusted under 35 U.S.C. 154(b) by 692 days.

(21) Appl. No.: 15/370,259

(22) Filed: Dec. 6, 2016

(65) Prior Publication Data

US 2018/0155173 A1 Jun. 7, 2018

(51) Int. Cl.
*B67B 3/20* (2006.01)

(52) U.S. Cl.
CPC ..... *B67B 3/2066* (2013.01); *B67B 3/20* (2013.01)

(58) Field of Classification Search
CPC .... B67B 3/2066; B67B 3/2073; B65B 7/2835
USPC ..... 53/331.5
See application file for complete search history.

(56) References Cited

U.S. PATENT DOCUMENTS 1,773,259 A * 8/1930 Cundall ..... B67B 3/2033 141/319
3,906,706 A * 9/1975 Conti ..... B67B 3/2066 53/331.5
3,984,965 A * 10/1976 Sonnenberg ..... B67B 3/2066 53/331.5
4,178,733 A * 12/1979 Dankert ..... B67B 3/2073 53/331.5
4,267,683 A * 5/1981 Harrington ..... B67B 3/2073 53/331.5
4,277,929 A * 7/1981 Schindel ..... B67B 3/20 53/331.5
4,309,859 A * 1/1982 Schindel ..... B67B 3/2066 53/331.5
4,674,263 A * 6/1987 Kelly ..... B67B 3/2066 53/317
5,327,697 A * 7/1994 Kent ..... B67B 3/2073 53/331.5
5,437,140 A * 8/1995 Molinaro ..... B67B 3/22 53/331.5
6,508,046 B1 * 1/2003 Resterhouse ..... B67B 3/2066 53/331.5
8,220,225 B1 * 7/2012 Zemlin ..... B67B 3/2066 53/331.5
2002/0184853 A1 * 12/2002 Arrant ..... B65B 7/2835 53/343
2006/0150580 A1 * 7/2006 Joerg ..... B67B 3/2066 53/317
2006/0162286 A1 * 7/2006 Spether ..... B67B 3/2066 53/331.5
2007/0084151 A1 * 4/2007 Brown ..... B67B 3/2066 53/490
2008/0028892 A1 * 2/2008 Cirio ..... B67B 3/2066 81/3.4
2008/0127611 A1 * 6/2008 Brown ..... B67B 3/2066 53/317

(Continued)

OTHER PUBLICATIONS

U.S. Appl. No. 13/865,0256, filed Apr. 18, 2013.
U.S. Appl. No. 13/445,185, filed Apr. 12, 2012.
U.S. Appl. No. 13/136,186, filed Jul. 24, 2011.

*Primary Examiner* — Anna K Kinsaul
*Assistant Examiner* — Daniel Jeremy Leeds

(57) ABSTRACT

A bottle capping chuck that uses serrated segments with a cap torque ramp angle to grip and torque a bottle cap combined with other segments that utilize holding segments both combining to eliminate slippage and stripping and holding of bottle caps during a bottle capping process.

1 Claim, 7 Drawing Sheets

(56) References Cited

U.S. PATENT DOCUMENTS

| | | | | |
|---|---|---|---|---|
| 2009/0308025 | A1* | 12/2009 | Martin | B67B 3/2066<br>53/317 |
| 2010/0077700 | A1* | 4/2010 | DeLuca | B67B 3/2086<br>53/331.5 |
| 2010/0095636 | A1* | 4/2010 | Cirio | B67B 3/2066<br>53/331.5 |
| 2010/0186349 | A1* | 7/2010 | Zanini | B65B 7/2835<br>53/317 |
| 2012/0227355 | A1* | 9/2012 | Schoenfelder | B67B 3/2066<br>53/287 |
| 2013/0255187 | A1* | 10/2013 | Zemlin | B67B 3/2066<br>53/317 |
| 2014/0123597 | A1* | 5/2014 | Mallett | B67B 3/2066<br>53/317 |
| 2014/0311089 | A1* | 10/2014 | Scott | B67B 3/2066<br>53/331.5 |
| 2015/0217982 | A1* | 8/2015 | Groninger | B67B 3/2066<br>53/317 |

* cited by examiner

CAPPING CHUCK ASSEMBLY

BACKGROUND OF THE INVENTION

This application incorporates by reference the following patent applications for what they teach in regard to bottle capping chucks and headsets.

Patent application Ser. No. 13/365,256 entitled "Bottle Capping Chucks", filed on Apr. 18, 2013.

Patent application Ser. No. 13/445,185 entitled "Dairy Capping Headset and Chuck", filed on Apr. 12, 2012.

Patent application Ser. No. 13/136,184 entitled "Bottle Capping Chuck", filed on Jul. 24, 2011.

THE INVENTION

The invention comprises in part a stationary hub that has a set of angled surfaces that interface with floating jaw segments. When the hub is driven in a clockwise direction, the segments are driven through this angle. This angle creates a force which pushes the segments toward the center of the hub, thereby gripping an inserted cap more strongly. If the desire is to torque a product onto something in a clockwise direction, this ramp angle can be reversed to provide enhanced gripping in the counterclockwise direction.

Thus, the present invention is a capping chuck assembly. The assembly comprises a housing that has an operating end and a threaded end. The housing has a central opening therethrough. The operative end comprises a hub that has an even number of spaced-apart notches therein. The spaced-apart notches have resident therein a first independently radially movable chuck segment. The first chuck segment has a front surface that has a plurality of serrations positioned thereon for torqueing a bottle cap. The operative end comprises a torque assembly. The ramp angle for cap torque is in the range of 36 to 45°.

The second evenly spaced-apart notches alternating with regard to the first spaced-apart notches and third evenly spaced apart notches has resident therein a second independently radially movable chuck segment. Each of the second chuck segments has a top edge and a bottom front edge. Each of the bottom front edge has an extended lip thereon and extending into the central opening. Each of the top edge is positioned distant from the central opening to create a non-vertical chuck segment or second chuck segment that is cantilevered and resting on the hub. The second independently radially moveable chuck segment provides a cap holding assembly.

Also, third evenly spaced-apart notches have resident therein, stationary chuck segments.

This hub has a horizontally grooved outside surface. Each of the chuck segments have a horizontally grooved back surface aligning with the grooves in the hub and configured for receiving a retainer ring therein.

There is a common retainer ring located in the hub grooves and the chuck segment grooves.

DETAILED DESCRIPTION OF THE DRAWINGS

Figure 1A:
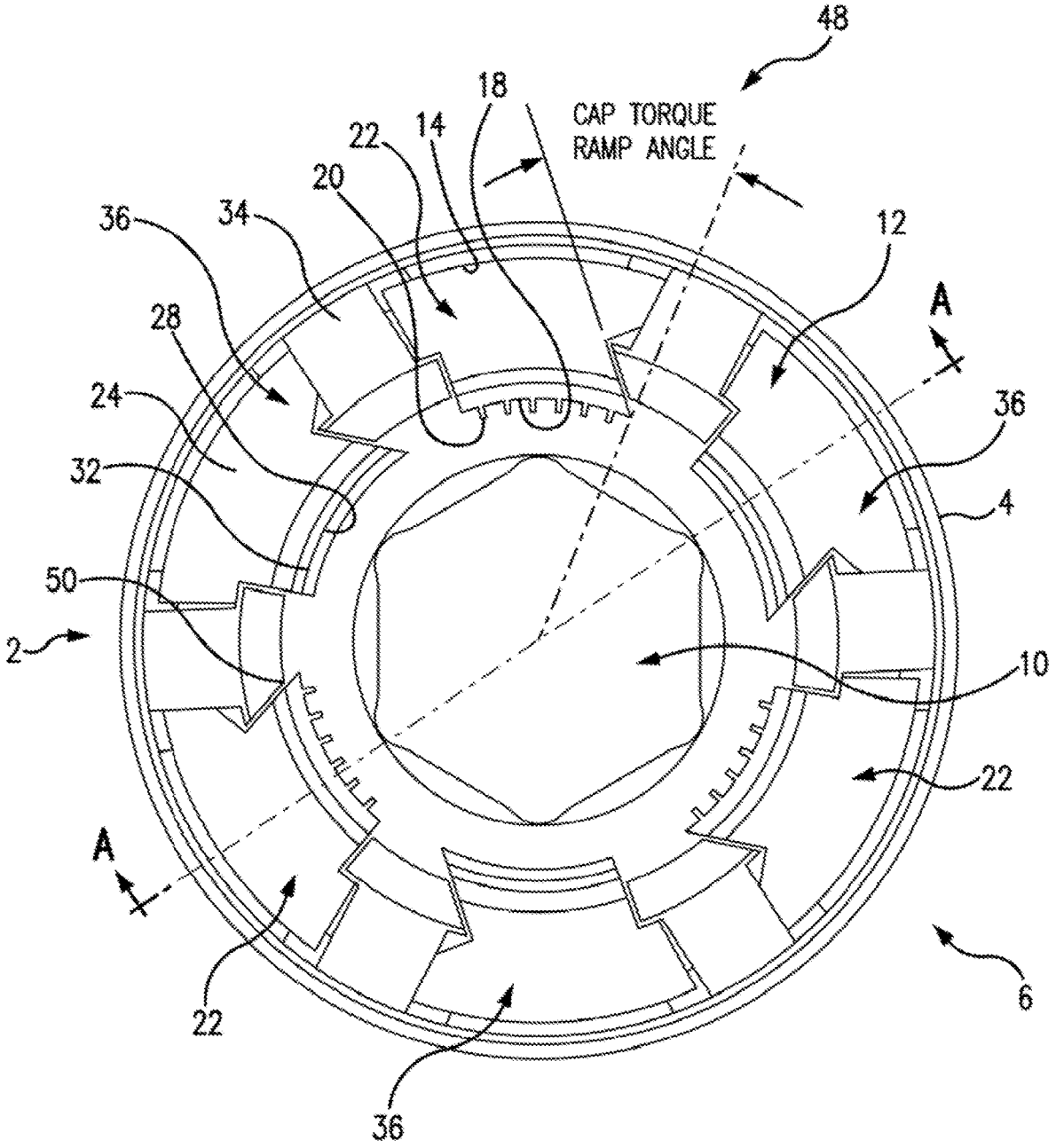
FIG. 1A is a full bottom view of a chuck of this invention showing a horizontal line and the torque ramp angle of the segment.
Figure 1B:
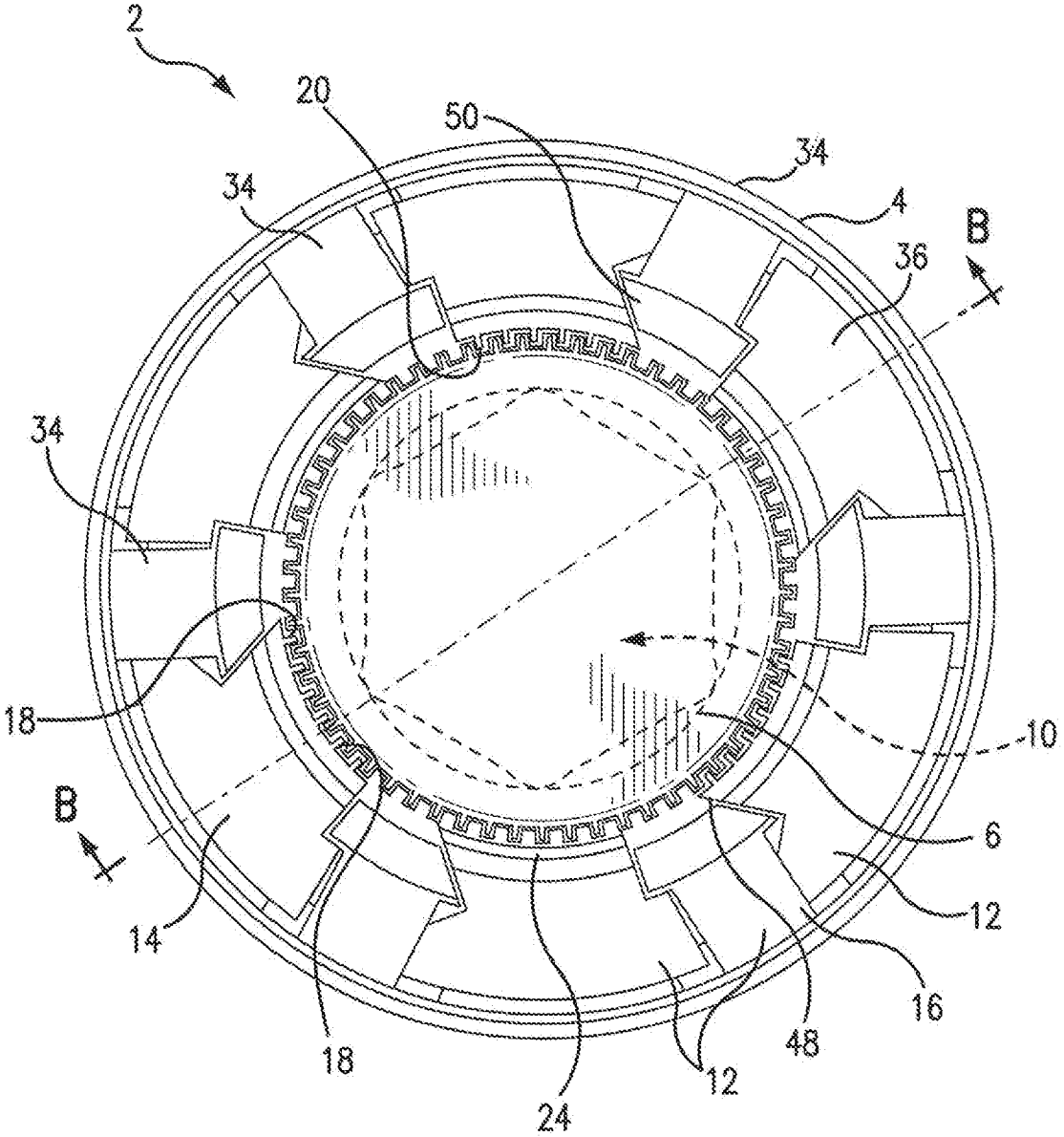
FIG. 1B is a full bottom view of a chuck of this invention.
Figure 2:
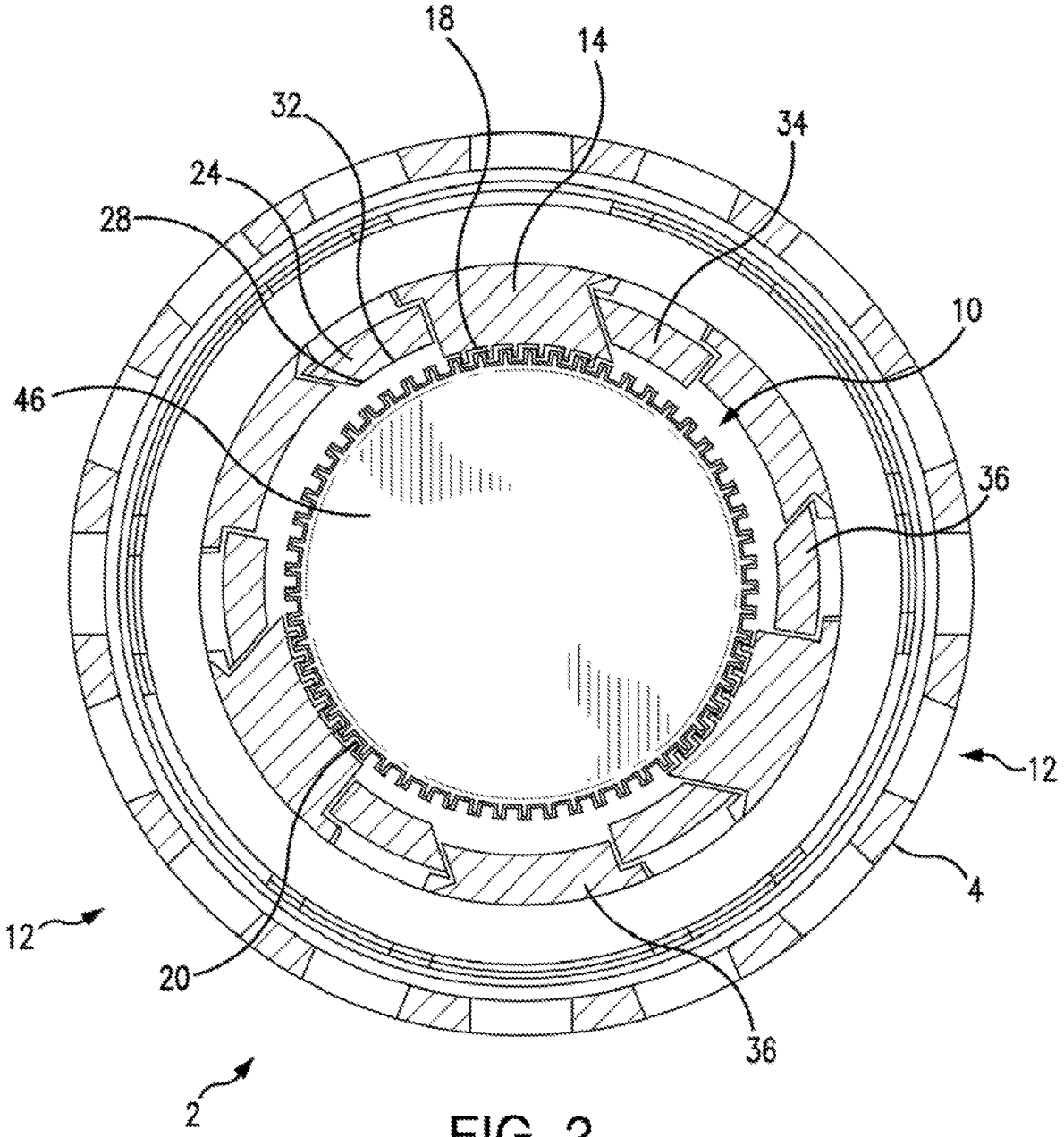
FIG. 2 is the view of FIG. 1 with a bottle cap inserted into the chuck.

FIG. 1A shows the capping chuck 2 from the operating end 6 and showing line A-A. The other end or the threaded end 8 (shown in FIG. 3) attaches to a bottle capping machine and drives the capping chuck 2. The capping chuck 2 has a central opening therethrough 10. The capping chuck 2 has a housing 4 and within this housing 4 is an operational end hub 12. The operational end hub 12 has within it an even number of spaced-apart notches. The first spaced-apart notches 60 have resident therein first independently radially movable chuck segments 14. A first chuck segment 14 has a front surface 18 that has a plurality of serrations 20 positioned thereon for torqueing a bottle cap 46 (FIG. 2). The first independently radially movable chuck segment 14 has a cap torque ramp angle 48 of 36° to 45° on each first end 50 of each first independently radially movable chuck segment 14, said angle relative to a horizontal line drawn through the center of the housing.

The first chuck segments 14 are torque segments; the second chuck segments 24 are holding segments, and the third chuck segments 34 are stationary segments.

Figure 5:
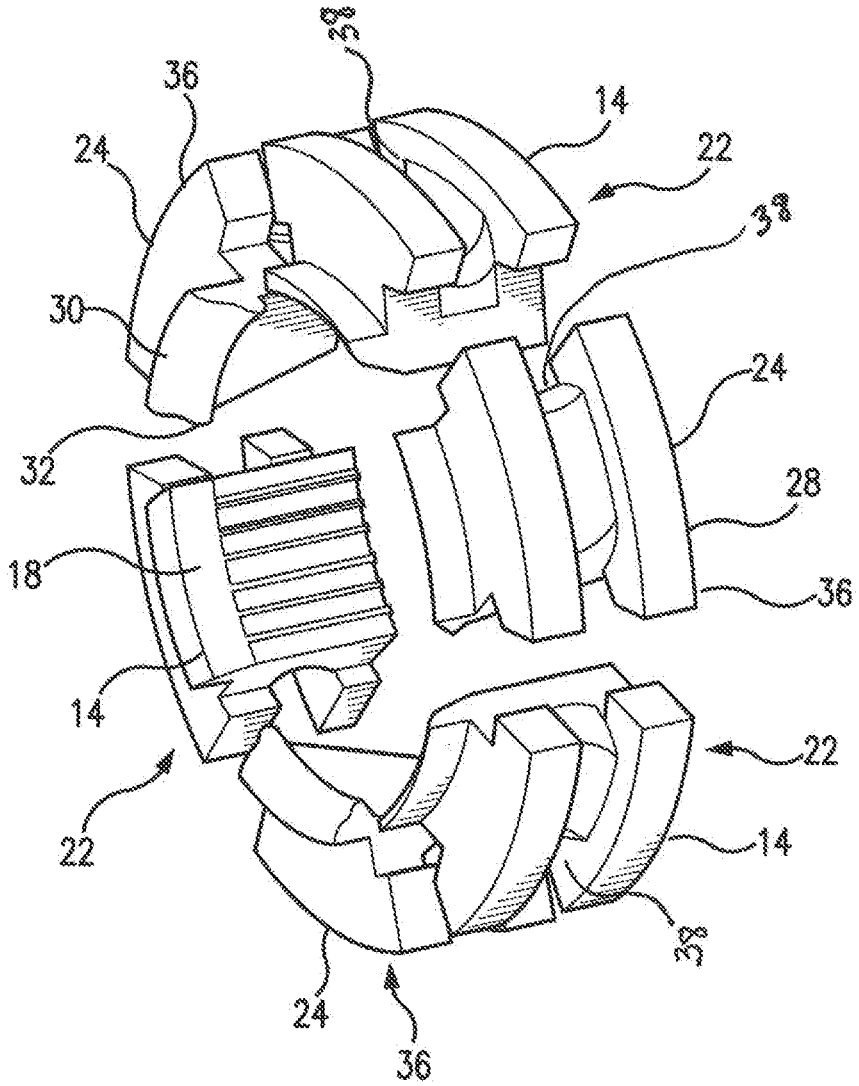
FIG. 5 is a view in perspective of the first independently radially movable chuck segments and second independently radially movable chuck segments.

The second evenly spaced-apart notches are alternating with regard to the first spaced-apart notches 34 and have resident therein a second independently radially movable chuck segment 24. Each of the second chuck segments 24 have a top edge 28 and a bottom front edge 30 (FIG. 5). Each of the bottom front edge 30 has an extended lip 32 thereon and extending towards the central opening 10. Each of the top edge 28 is positioned distant from the central opening 10 to create a non-vertical chuck segment cantilevered and resting on the hub 12. The second independently radially moveable chuck segment 24 provides a cap holding assembly 36.

Also shown are third stationary chuck segments 34. Not shown is the outside groove 40 (shown in FIG. 6) surface of the third stationary chuck segment 34. The third stationary chuck segments 34, the first independently radially movable chuck segment 14, and the second independently radially movable chuck segment 24, combine to create the operating end hub 12. The first independently radially moveable chuck segments 14 combine to form the torque assembly 22. The second independently radially moveable chuck segments combine to create the cap holding assembly 36.

FIG. 2 shows the capping chuck 2 from the operating end 12 with a bottle cap 46 inserted into the capping chuck 2. The other end or the threaded end 8 (shown in FIG. 3) attaches to a bottle capping machine and drives the capping chuck 2. The capping chuck 2 has a central opening therethrough 10. The capping chuck 2 has a housing 4 and within this housing 4 is the operational end hub 12. The operational end hub 12 has within it an even number of spaced-apart notches. The first spaced-apart notches 60 have resident therein a first independently radially movable chuck segment 14. Each first chuck segment has a front surface 18 that has a plurality of serrations 20 positioned thereon for torqueing a bottle cap 46. The serrations 20 engage the bottle cap 46. This grips the bottle cap 46 allowing it to be torqued on to a bottle without stripping the cap 46, or over tightening, which are critical issues in the bottle capping industry. It has been discovered that the ramp angle which ranges between 36° to 45°, and preferably 39° to 42° and most preferably at about 41° of the ramp angle 48 allows the torqueing without the stripping of the bottle cap 46. This gives the present device a greater utility over any other prior art device.

The second evenly spaced-apart notches alternate with regard to the first spaced-apart notches 34 and they have resident therein a second independently radially movable chuck segment 24. Each of the second chuck segments 24 have a top edge 28 and a bottom front edge 30 (Shown in FIG. 4). Each of the bottom front edge 30 has an extended lip 32 thereon and extending towards the central opening 10. Each of the top edge is positioned distant from the central opening 10, creates a non-vertical chuck segment for the second evenly spaced-apart chuck segments 24 that are cantilevered and resting on the hub 12. The second independently radially moveable chuck segment 24 provides a cap holding assembly 36. The extended lip 32 engages a bottom outside surface of the bottle cap 46 holding it in place. This element is also key to the utility of the present invention, in that, the torqueing assembly of the serrated segments 20 of the first independently radially movable chuck segment 14 torques the bottle cap 46 while the second independently radially movable chuck segment 24 holds the bottle cap 46 in place while the serration 20 of the first independently radially movable chuck segments 14 are torqueing the bottle cap 46 (the assembly). It has been discovered that this prevents slipping and stripping of the bottle cap 46 while holding the cap in place.

Figure 3:
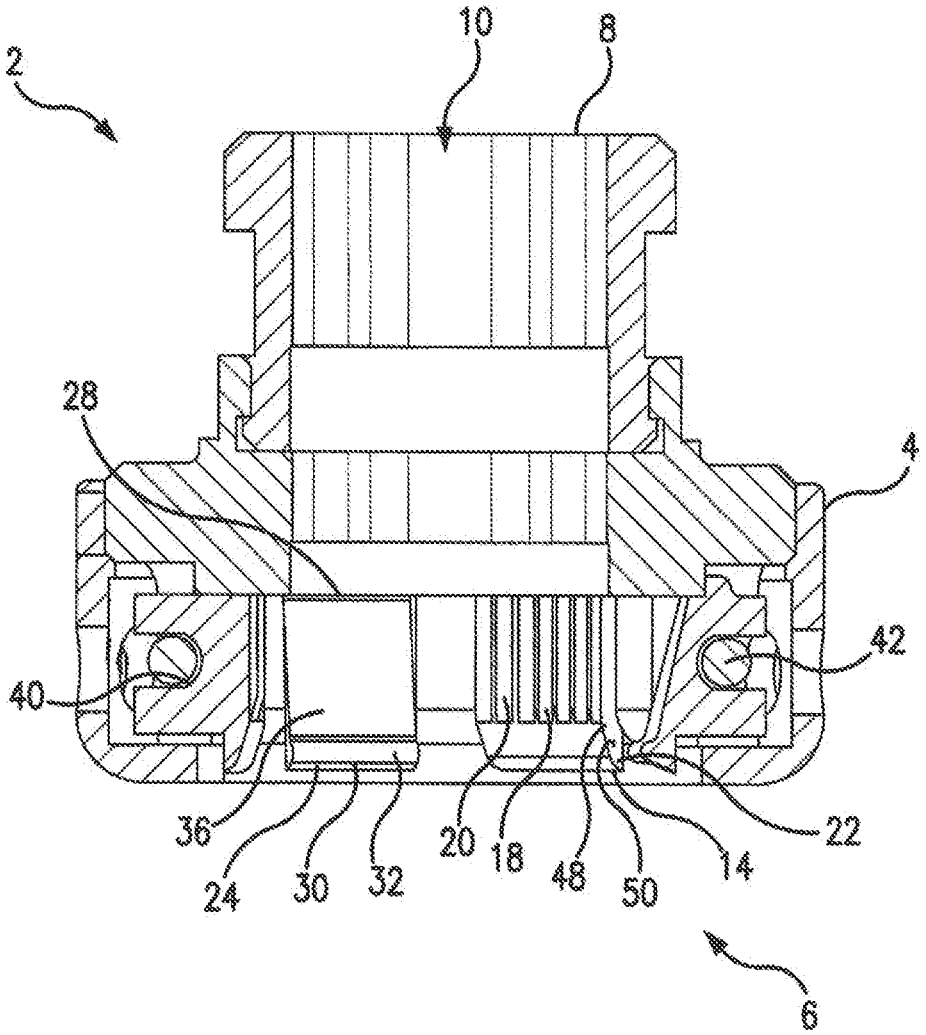
FIG. 3 is a full cross sectional side view of the chuck of FIG. 1B along line A-A exposing the interior of the capping chuck.

FIG. 3 shows the capping chuck 2 along line A-A exposing the interior of the capping chuck 2. Each of the bottom front edges 30 are positioned distant from the central opening 10 to provide second chuck segments 24, cantilevered and resting on the hub 12. The second independently radially moveable chuck segments 24 provide a cap holding assembly 36.

Figure 6:
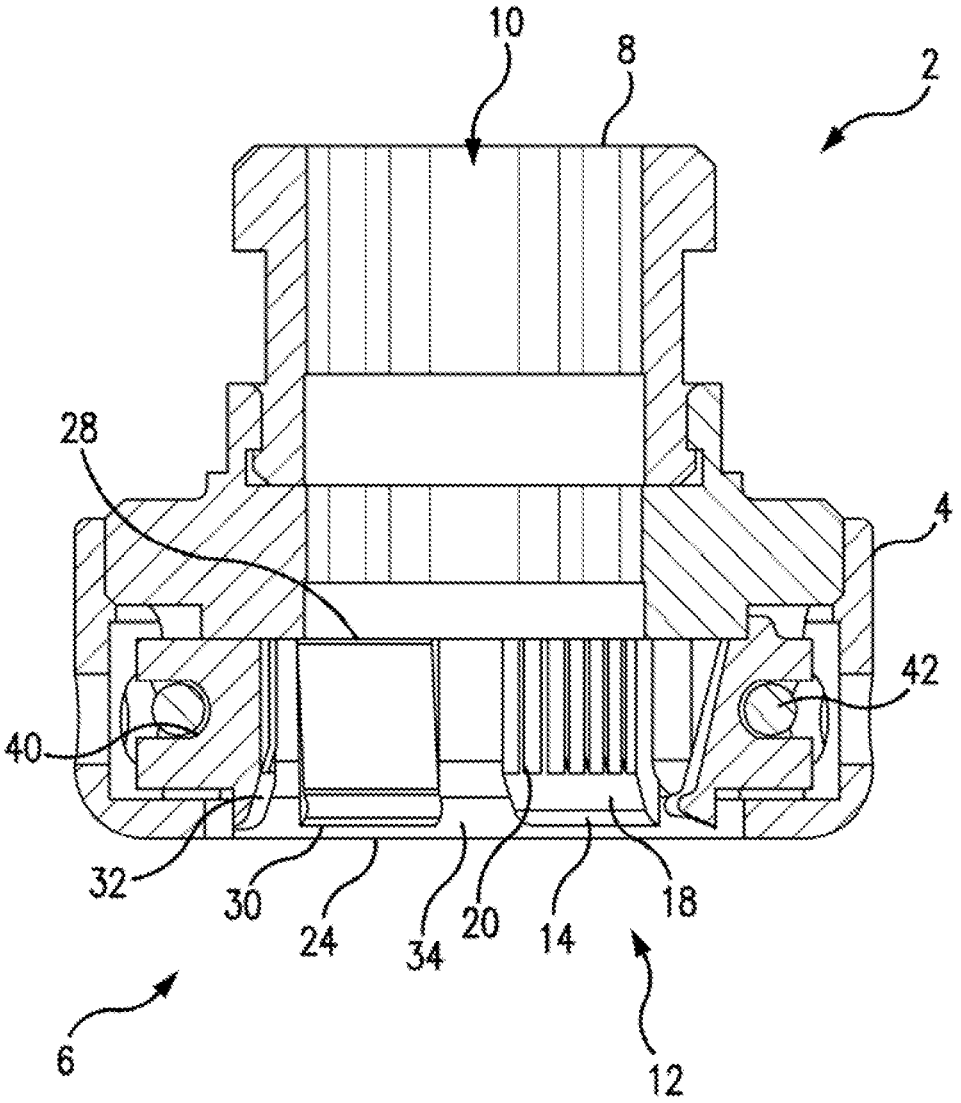
FIG. 6 is a full side view of the housing of this invention along line A-A.

This hub 12 has a horizontally grooved outside surface 38 (FIG. 6). Each of the chuck segments 14 and 24 have a horizontally rounded, grooved back surface 40 aligning with the grooves 38 in the hub 12 and configured for receiving a retainer ring 42 therein.

There is a common retainer ring 42 located in the grooves 38 and the chuck segment grooves 40 (see FIG. 6). There is no bottle cap 46 inserted into the capping chuck 2 so the retainer ring 42 is relaxed as compared to when a bottle cap 46 is inserted therein which places more pressure on the retainer ring 42.

Retainer rings useful in this invention can be the typical retainer rings such as rubber O-rings or spring metal rings or the like.

Figure 4:
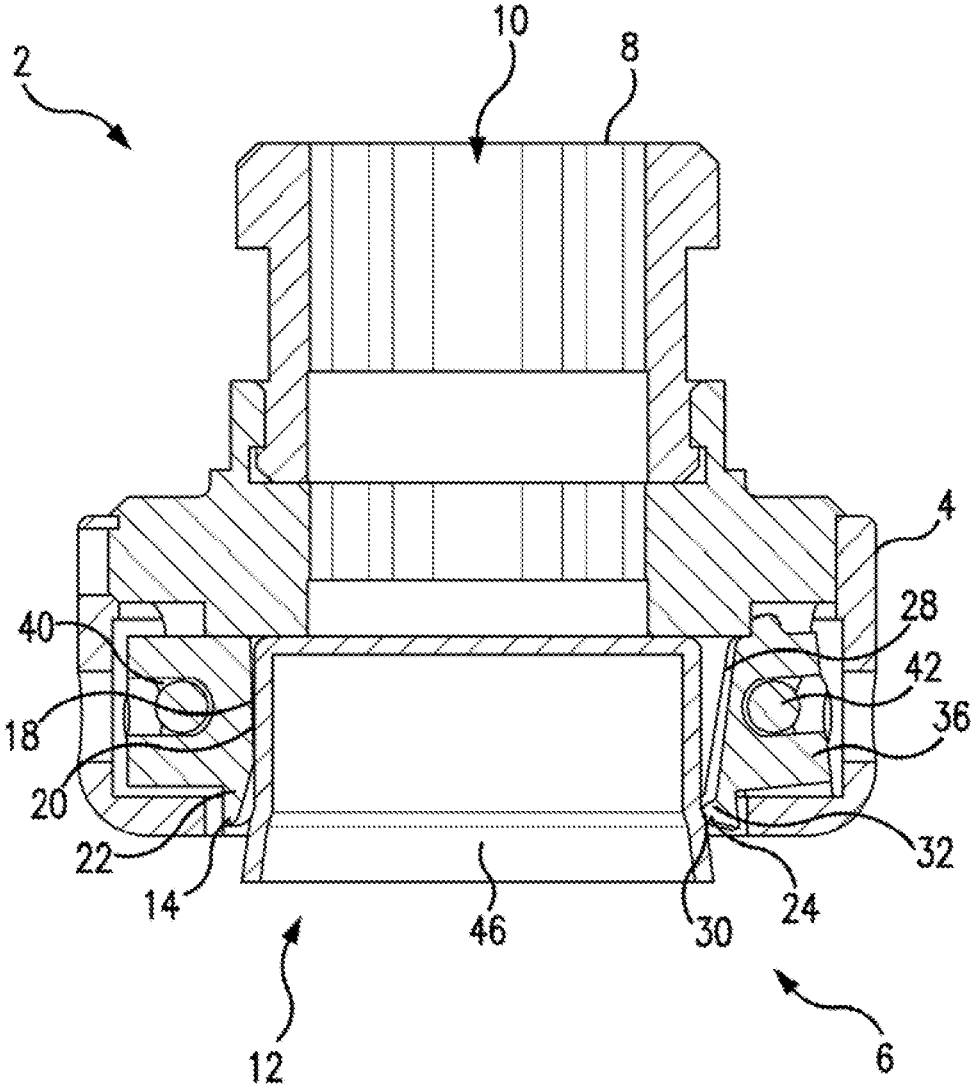
FIG. 4 is a full cross sectional side view of the chuck of FIG. 2 along line B-B exposing the interior of the capping chuck with a bottle cap in the capping chuck.

FIG. 4 shows the capping chuck 2 along line B-B exposing the interior of the capping chuck 2, with a bottle cap 46 in the capping chuck 2. Each of the bottom front edges 30 positioned distant from the central opening 10 create a non-vertical chuck segment or second chuck segments 24 that are cantilevered and resting on the hub 12. The second independently radially moveable chuck segment 24 provides a cap holding assembly 36.

There is a common retainer ring 42 located in the hub 12 grooves 38 and the chuck segment grooves 40. The angle of the second independently radially movable chuck segment 24 changes with the insertion of the bottle cap 46 which is critical to the utility of the present invention, in that, the second independently radially movable chuck segment 24 only places pressure on the bottle cap 46 at the second independently radially movable chuck segment 24 extended lip 32. Holding the bottle cap 46 prevents it from falling out of the chuck. It has been discovered that holding the bottle cap 46 in this manner gives the present invention a greater utility over any other prior art devices.

FIG. 5 shows the first independently radially movable chuck segments 14 and second independently radially movable chuck segment 24.

The first spaced-apart notches 60 have resident therein, first independently radially movable chuck segments 14. First chuck segments 14 have a front surface 18 that has a plurality of serrations 20 positioned thereon for torqueing a bottle cap 46. These combine to form the torque assembly 22.

Each of the second chuck segments 24 has a top edge 28 and a bottom front edge 30. Each of the bottom front edge 30 has an extended lip 32. All of these combine to form the bottle cap holding assembly 36.

FIG. 6 is a full side view of the housing of this invention along line A-A. The capping chuck 2 from the operating end 6 and showing line A-A. The other end or the threaded end 8 (shown in FIG. 3) attaches to a bottle capping machine and drives the capping chuck 2. The capping chuck 2 has a central opening 10 therethrough. The capping chuck 2 has a housing 4 and within this housing 4 is an operational end hub 12. The operational end hub 12 has within it an even number of spaced-apart notches therein. The first spaced-apart notches 60 have resident therein first independently radially movable chuck segments 14. A first chuck segment 14 has a front surface 18 that has a plurality of serrations 20 positioned thereon for torqueing a bottle cap 46. The first independently radially movable chuck segment 14 has a cap torque ramp angle 48 of 36° to 45° on each first end 50 of each first independently radially movable chuck segment 14, said angle relative to a horizontal line drawn through the center of the housing.

The first chuck segments 14 are torque segments, the second chuck segments 24 are holding segments, and the third chuck segments 34 are stationary segments.

The second evenly spaced-apart notches are alternating with regard to the first spaced-apart notches 34 and have resident therein a second independently radially movable chuck segment 24. Each of the second chuck segments 24 have a top edge 28 and a bottom front edge 30 (FIG. 5). Each of the bottom front edge 30 has an extended lip 32 thereon and extending towards the central opening 10. Each of the top edge 28 is positioned distant from the central opening 10 to create a non-vertical chuck segment cantilevered and resting on the hub 12. The second independently radially moveable chuck segment 24 provides a cap holding assembly 36.

Also shown are third stationary chuck segments 34. Shown is the outside groove surface of the third stationary chuck segment 34. The third stationary chuck segments 34, the first independently radially movable chuck segment 14, and the second independently radially movable chuck segment 24, combine to create the operating end hub 12. The first independently radially moveable chuck segments 14 combine to form the torque assembly 22. The second independently radially moveable chuck segments combine to create the cap holding assembly 36. The retention ring 42 is also present.

There is a mechanical advantage in that the stationary hub 12 has a set of angled surfaces 14 that interface the first 14 and second segments 24. When the hub 12 is driven in a clockwise direction, the segments are driven through this angle. This angle 14 creates a force which pushes the segments toward the center of the hub 10, thereby gripping the cap 46 more strongly. If the desire was to torque a product onto something in a clockwise direction, this ramp angle 48 could be reversed to provide the enhanced gripping on the counterclockwise direction.

What is claimed is:

1. A capping chuck assembly, said assembly comprising:

a. a housing having an operating end and a threaded end, said housing having a central opening therethrough;

b. said operating end comprising a torque assembly, an even number of spaced-apart notches formed between stationary chuck segments, said stationary chuck segments having a horizontally grooved outside surface;

c. located in each alternating spaced-apart notch there is resident therein a first independently radially movable chuck segment having a first end, said first independently radially movable chuck segment having a front surface having a plurality of serrations positioned thereon for torqueing a bottle cap;

d. located in the remaining alternating evenly spaced-apart notches, there is resident therein a second independently radially movable chuck segment, wherein each second chuck segment has a top edge and a bottom front edge, each said bottom front edge having an extended lip thereon and extending into said central opening, wherein said second independently radially moveable chuck segment is cantilevered and, said second independently radially moveable chuck segment provides a cap holding assembly;

e. each said first independently radially movable chuck segment and second independently radially movable chuck segment having a horizontally grooved rounded back surface aligning with said groove in said stationary chuck segments and configured for receiving a retainer ring therein;

f. a common retainer ring located in said first, second and stationary chuck segment grooves;

g. a cap torque ramp angle in the range of 36° to 45° wherein said cap torque ramp angle is derived from the ramp angle on said first end of said first independently radially movable chuck segment and opposing edge of said stationary chuck segment wherein the cap torque ramp angle creates a force thereby gripping the cap more strongly.

* * * * *